United States Patent [19]

Miles

[11] 4,235,216

[45] Nov. 25, 1980

[54] AUXILIARY STARTER MECHANISM FOR AUTOMOBILE ENGINES AND THE LIKE

[76] Inventor: Norval W. Miles, 24833 16th Ave., Space #46, Madera, Calif. 93637

[21] Appl. No.: 15,357

[22] Filed: Feb. 26, 1979

[51] Int. Cl.[3] ..... F02N 7/00

[52] U.S. Cl. ..... 123/179 E; 123/179 F; 60/626

[58] Field of Search ..... 123/179 E, 179 F, 179 M, 123/179 P, 179 R; 60/626, 625

[56] References Cited

U.S. PATENT DOCUMENTS

| | | | |
|---|---|---|---|
| Re. 13,681 | 1/1914 | Stuller | 123/179 F |
| 1,006,063 | 10/1911 | Clarke | 123/179 F |
| 1,049,084 | 12/1912 | Hartsock et al. | 123/179 F |
| 1,210,360 | 12/1916 | Poulson | 123/179 F |
| 2,845,916 | 8/1958 | Pihiel | 123/179 F |
| 3,182,650 | 5/1965 | Heckt | 123/179 F |
| 3,633,360 | 1/1972 | Kelley | 123/179 F |
| 3,991,734 | 11/1976 | Martin | 123/179 E |
| 4,170,211 | 10/1979 | Worthington | 123/179 E |

*Primary Examiner*—Charles J. Myhre
*Assistant Examiner*—Andrew M. Dolinar
*Attorney, Agent, or Firm*—Huebner & Worrel

[57] ABSTRACT

An auxiliary starter mechanism for automobile engines and the like for use in starting the engine when the primary starting system provided with the engine is inadequate for the purpose, the mechanism having a reservoir containing a gas such as air under pressure; a control valve operable from a driver's position of the automobile; an air motor mounted on the primary starting system of the engine and operable to drive the primary starting system; and a conduit interconnecting the reservoir, control valve and air motor in series relation for driving the air motor and thus the primary starting system upon opening of the control valve.

4 Claims, 6 Drawing Figures

Fig. 1
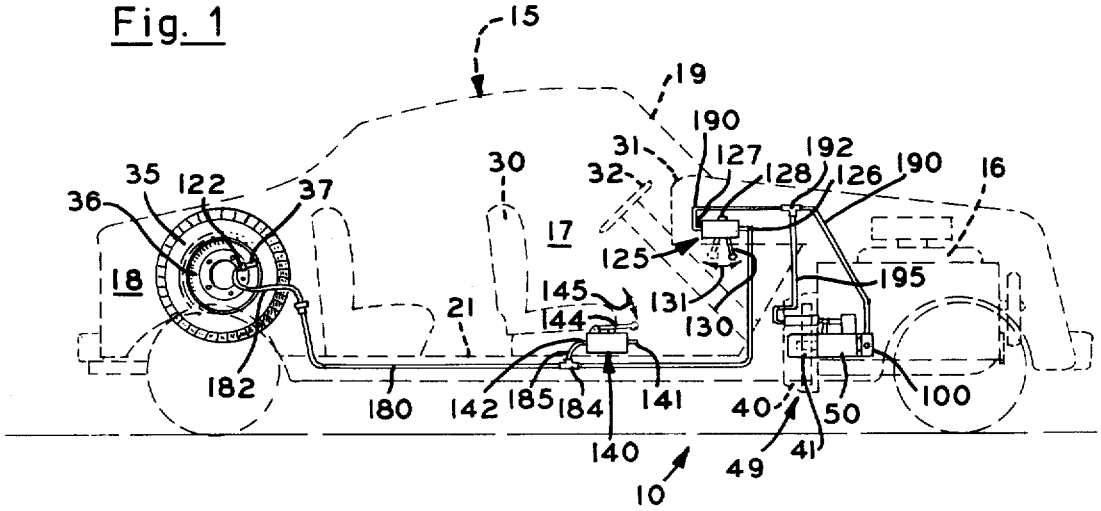
Fig. 2
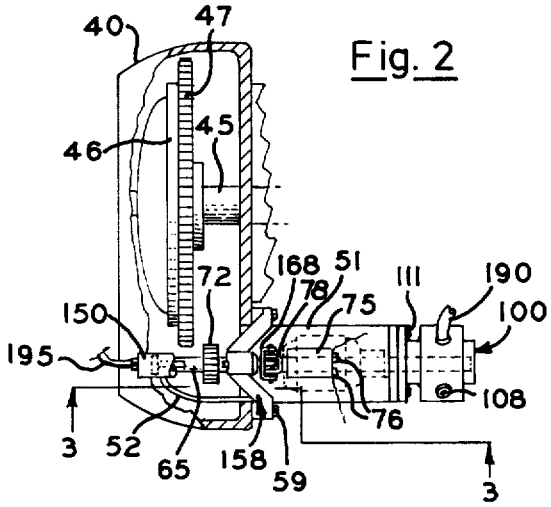
Fig. 4
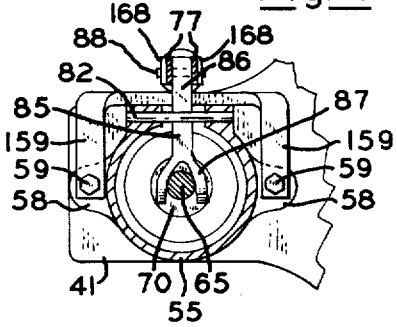
Fig. 5
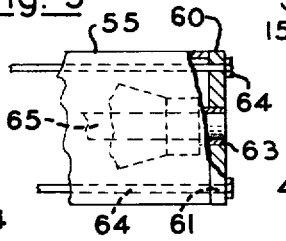
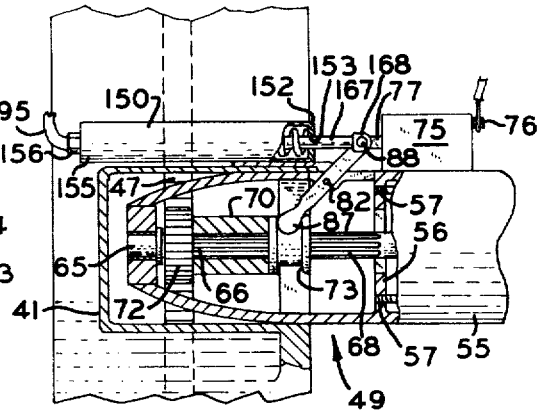
Fig. 6
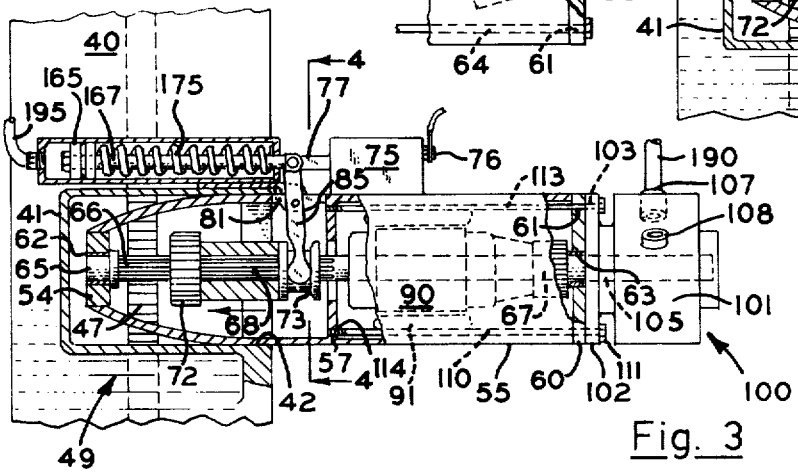
Fig. 3

AUXILIARY STARTER MECHANISM FOR AUTOMOBILE ENGINES AND THE LIKE

BACKGROUND OF THE INVENTION

1. Field of the Invention

The present invention relates to an auxiliary starter mechanism for automobile engines and the like, and more particularly to such a mechanism which is adapted for use in starting the engine when, as in cold weather, the primary starting system of the engine is inadequate for the purpose and which is particularly well suited for installation on existing automobiles.

2. Description of the Prior Art

A chronic difficulty with conventional starting systems for automobile engines or those of like vehicles resides in the fact that they are on occasion inadequate for starting the engines. This insufficiency can be due to conditions external to the automobile such as cold weather in the case of starting systems of the electrical type. This insufficiency can also be due to failure of electrical system components such as the battery. Such failures are often without warning. The resulting inability to operate the vehicle is inconvenient at best and can be dangerous in certain conditions.

Starting systems powered by pressure produced pneumatically, hydraulically or by combustion are known. However, insofar as the applicant is aware, such systems are utilized either as the sole starting apparatus for "off-the-road" vehicles, aircraft, or stationary engines or are intended for use as auxiliary starting systems for gas turbines. As a result these systems are both expensive and ill-adapted for use on conventional automobiles.

Characterizing the closest prior art of which the Applicant is aware and in compliance with 37 C.F.R. § 1.97 and § 1.98, attention is invited to the following patents which are relevant in their relation to starting systems for internal combustion engines utilizing a pressurized gas or liquid. Copies of these patents are attached as follows:

U.S. Pat. No. 1,049,084—Hartsock et al.; Dec. 31, 1912

U.S. Pat. No. 2,845,916—Pihiel; Aug. 5, 1958

U.S. Pat. No. 3,633,360—Kelley; Jan. 11, 1972

U.S. Pat. No. 3,991,734—Martin; Nov. 16, 1976

The Hartsock et al. patent discloses a motor starter of the pneumatic type.

The Pihiel patent relates to an hydraulic starting system for internal combustion engines.

The Kelley patent is directed to a boost starter system.

The Martin patent reveals a starting system for internal combustion engines of the compression ignition type.

SUMMARY OF THE INVENTION

Accordingly, it is an object of the present invention to provide an improved auxiliary starter mechanism for automobile engines and the like.

Another object is to provide such a mechanism which is adapted to be utilized when the primary starting system of the engine is inadequate for starting purposes.

Another object is to provide such a mechanism which is well suited to installation on existing vehicles.

Another object is to provide such a mechanism which is pneumatically operated, but does not require a storage tank for air, or a similar gas, under pressure individual thereto.

Another object is to provide such a mechanism which utilizes elements of the existing electrical starting system of an engine.

Another object is to provide such a mechanism powered by pneumatic pressure capable of using an inflated tire for purposes of operation, but which possesses the capability of being operated even when there is no such reservoir of a gas under pressure available.

Another object is to provide such a mechanism which is fully compatible with the existing starting system of the engine so that it can remain in place for immediate use when necessary.

Another object is to provide such a mechanism which is particularly useful in cold weather.

Still another object is to provide an auxiliary starter mechanism for automobile engines and the like which is economical, durable, easily installed, and fully effective in performing its intended function.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 1 is a partially diagrammatic side elevation of an automobile provided with an auxiliary starter mechanism embodying the principles of the present invention.

FIG. 2 is a somewhat enlarged, fragmentary, top plan view of the mechanism of FIG. 1 shown mounted on the primary electrical starting system of the automobile.

FIG. 3 is a somewhat further enlarged vertical section taken on line 3—3 of FIG. 2 and showing the mechanism in a disengaged attitude.

FIG. 4 is a transverse vertical section taken from the position indicated by line 4—4 in FIG. 3.

FIG. 5 is a fragmentary view of a portion of the primary electrical starting system of FIG. 3 prior to installation of the auxiliary starter mechanism of the present invention.

FIG. 6 is a fragmentary, vertical section similar to that of FIG. 3, but showing the mechanism in an engaged operative attitude.

DESCRIPTION OF THE PREFERRED EMBODIMENT

Referring more particularly to the drawings, the auxiliary starter mechanism for automobile engines and the like of the present invention is depicted in FIG. 1 in a typical operative environment and generally indicated by the numeral 10 therein.

As shown in FIG. 1, the mechanism 10 is mounted on an automobile indicated in dashed lines at 15. For purposes of descriptive convenience, it will be understood that the automobile has a forwardly disposed engine 16 of the conventional, reciprocating, internal combustion type, a driver's position 17 rearward of the engine, and a rearwardly disposed trunk 18 for the storage of luggage or like articles to be transported. The engine, driver's position, and trunk are enclosed by a body 19 having a floor 21.

The driver's position 17 has a seat 30 secured on the floor 21, a dash console 31 with a leg space therebelow, and a steering column 32 extended from the floor below the console toward the seat. A spare tire 35 mounted on a wheel 36 is disposed within the trunk 18. The tire mounts a valve stem 37 for purposes of inflating the tire. As will subsequently be described, the spare tire constitutes an element of the mechanism 10 of the present invention.

The engine 16 has a bell housing 40 disposed toward the driver's position 17. The bell housing and certain other elements of the engine have a special relationship to the mechanism 10 and are shown in greater detail in FIGS. 2, 3, 4 and 6. The bell housing has a laterally projecting extension 41. The extension has a forwardly facing circular opening 42. The engine has a crankshaft 45, which extends into the bell housing. A flywheel 46 is fixedly mounted in the crankshaft for rotation therewith within the bell housing. A ring gear 47 is affixed on the fly wheel in circumscribing relation thereto for rotation with the wheel and the crankshaft.

The engine 16 has a primary or electrical starting system 49 of conventional type provided for the engine at the time of manufacture and which is ordinarily capable of starting the engine without assistance. Although it will be recognized that the auxiliary starter mechanism of the present invention is adaptable for use in supporting relation to a variety of types of starting systems, starting system 49 is characteristic of the type perhaps most commonly in use. The electrical starting system has an electric starting unit or motor 50 mounted on the extension 41. The starter motor shown in the drawings is of the well known inertia gear drive type and need not be described in detail. Furthermore, it will become apparent that the auxiliary starter mechanism of the present invention operates equally well with a wide variety of types of starter motors.

Insofar as the present invention is concerned, it is sufficient to note that the starter motor 50 has an electrical portion 51 disposed forwardly of the extension 41 of the bell housing 40. The starter motor has a mechanical portion 52 extending rearwardly from the electrical portion through the opening 42 and into the extension of the bell housing to a rearward end 54. The rearward end is offset relative to the ring gear 47 and rearwardly thereof. The starter motor has a generally cylindrical housing 55 which encloses both the electrical and mechanical portions and extends through the opening 42. The axis of the housing 55 is substantially parallel to the axis of the crankshaft 45 and ring gear 47. The housing has an annular ring or partition 56 between the electrical and mechanical portions thereof. The partition has screw threaded bores 57 which are parallel to the axis of the housing and positioned just inwardly of the housing. The housing 55 has a pair of ears 58 which engage the exterior of the extension 41 of the bell housing 40 on opposite sides of the bore 42. The starter motor is mounted on the bell housing 40 by a pair of bolts 59 which extend individually through the ears and are screw-threadably secured in screw threaded bores, not shown, of the extension.

The starter motor 50 has a disk or end plate 60 having bores 61 which are aligned with the screw threaded bores 57 of the partition 56. A rearward bearing 62 is mounted on the rearward end 54 of the mechanical portion of the starter motor. A forward bearing 63 is mounted on the end plate 60 in axial alignment with bearing 62 so as to be coaxial with the housing 55. It will be understood that in conventional construction of the starter motor, bolts 64 are individually extended through the bores 61 and screw-threadably received in screw threaded bores 57 of the partition to hold the end plate in position on the housing. A unitary motor shaft 65 is rotationally received in the bearings 62 and 63. The motor shaft has a rearward axial end portion 66 disposed within the mechanical portion of the starter unit and an opposite forward end portion 67. The forward end portion is enclosed within the housing and the end plate. The rearward end portion is juxtapositioned to the ring gear 47 and has external splines 68 extending longitudinally about the periphery thereof, as best shown in FIGS. 3 and 6.

A pinion assembly 70 is mounted on the rearward end portion 66 of the shaft 65. The pinion assembly has internal splines, not shown mating with the splines 68 and is thus mounted on the shaft for rotation therewith and for slidable movement axially thereof. The pinion assembly mounts a pinion gear 72 adapted to mate with the ring gear 47 when the pinion assembly is moved along the motor shaft to position the pinion gear thereof as shown in FIG. 6. The pinion assembly has a guide ring 73 at the end thereof spaced from the pinion gear. The starter motor 50 has a solenoid 75 affixed on the housing 55 forwardly of the ears 58. The solenoid has a pair of electrical terminals 76 at the end thereof on the right, as viewed in FIG. 3, and has a rearwardly extending pull rod 77. The solenoid is, of course, operable to move the pull rod from the normal extended position shown in FIG. 3 to the retracted position shown in FIG. 6 upon being energized. The pull rod is substantially parallel to the motor shaft 65 and mounts a clevis 78 on the remote end thereof. The housing has a longitudinal slot 81 extending therethrough between the clevis end and the guide ring 73 of the pinion assembly 70. A first pin 82 is mounted on the housing and extends transversely of the slot. A lever 85 is pivotally mounted on the first pin and extends vertically through the slot. The lever has an upper end 86 disposed centrally of the clevis. The lever has a forked lower end 87 which embraces the pinion assembly and is fitted in the guide ring 73 thereof. A second pin 88 pivotally interconnects the clevis and the upper end of the lever 85. The opposite ends of the second pin project endwardly from the clevis in opposite directions for purposes subsequently to be described.

The electric portion 51 of the starter motor 50 has an electric motor armature 90 mounted on the forward end portion 67 of the shaft 65 for rotation therewith. Electric motor field coils 91 mounted on the housing in the conventional manner in circumscribing relation to the armature. The solenoid 75, field coils 91 and other portions of the starter motor 50 are wired in the conventional manner for operation as a conventional starter motor. Thus, in conventional use when the ignition of the automobile 15 is activated the solenoid 75 is energized to retract the pull rod 77 to the retracted position shown in FIG. 6. Such retraction carries the pinion assembly 70 along the motor shaft 65 to engage the pinion gear 72 and the ring gear 47. Simultaneously, the coils 91 are energized to rotate the armature and thus the motor shaft. Such rotation is transmitted through the pinion assembly to the ring gear. Accordingly, the flywheel 46 and crankshaft 45 are rotated until the engine 16 fires. Deactivation of the ignition causes the solenoid to retract the pinion gear from engagement with the ring gear and the starter motor to terminate rotation of the motor shaft 65. The engine, thus started, operates on its own.

The previously described elements of the engine 16 and its electrical starter motor 50 are of a conventional configuration and are installed on the automobile 15 at the time of manufacture. The auxiliary starter mechanism 10 of the present invention can also be installed at the time of manufacture of the automobile. However, the mechanism is particularly well suited for installation on existing automobiles subsequent to manufacture. For illustrative convenience, the mechanism 10 is described herein in its assembled condition on the automobile 15, it being understood that installation can be at the time of manufacture or any time thereafter.

The mechanism 10 has an air motor 100 mounted on the housing 55 in covering relation to the end plate 60. The air motor can be of any suitable type. However, the type shown and described herein is preferred. The air motor has a body 101 with a flange 102 dimensioned for facing engagement with the end plate 60 of the housing 55. Bores 103 extend through the flange in the same pattern as the bores 61 of the end plate 60. The air motor has an output shaft 105 which extends to an end flush with the outer face of the flange. When the air motor is mounted in position on the housing 55, the output shaft of the air motor and the end of the motor shaft 65 are disposed in end-to-end relation. The output shaft 105 is connected in rotational driving relation to the motor shaft 65 in any suitable manner. The output and motor shafts are preferably made of unitary construction, as by being welded together in axial alignment. The body of the air motor has an inlet connection 107 for air under pressure and has an exhaust opening 108. It will be understood that vanes or blades, not shown, are borne by the output shaft 105 within the body of the air motor for rotation with the output shaft. This is shown in FIG. 5 for illustrative convenience. Thus, when air under pressure is supplied to the inlet connection, the output shaft is rotated by the blades and the air then exhausted from the body to the atmosphere through the exhaust opening.

In order to mount the air motor 100 on the starter motor, the bolts 64 are removed from the bores 57 and 61. Elongated replacement bolts 110 are then individually extended through corresponding aligned bores 57, 61, and 103 and tightened into position. Each replacement bolt has a head 111 for engagement with the flange 102, an elongated shank 113, and a screw threaded end portion 114 for engagement with the screw threads of the bores 57 in the partition 56. The shank of each bolt is of a length such that, when the bolt is screw-threadably received in its respective bore 57, the head thereof clamps the flange 102 and the end plate 60 on the housing 55, as best shown in FIG. 3.

In the form of the invention shown and described herein the auxiliary starter mechanism 10 utilizes the spare tire 35, shown in FIG. 1, as a reservoir for air under pressure. This is believed to provide a number of unique advantages, as will hereinafter be set forth. However, it is to be understood that a tank or a plurality of tanks can be employed for this purpose. Such a tank can, of course, be positioned in the trunk 18 of the automobile 15 or be mounted on the automobile at any other suitable location. The mechanism 10 of the present invention has a connector 122 adapted for screw threaded engagement with the valve stem 37 and permitting air to flow from the tire through the valve stem.

A valve 125 is mounted on the underside of the console 31. The valve has an inlet connection 126, an outlet connection 127, and an exhaust connection 128 which is open to the atmosphere. The valve has a manually operable control lever 130 extending downwardly therefrom so as to be conveniently accessible from the driver's position. The control lever is mounted for selective pivotal movement, as indicated by the arrow 131, between a first position in which said inlet and outlet connections communicate with each other in air transferring relation and the exhaust connection is sealed and a second position in which the inlet and outlet connections are sealed from each other while the outlet connections and the exhaust connection communicate in air transferring relation.

The auxiliary starting mechanism 10 has a hand pump 140 mounted on the floor 21 of the body 19 of the automobile 15 below the seat 30. The pump has an inlet 141 for ambient air and an outlet connection 142. A handle 144 is operably mounted on the hand pump extending from beneath the seat for convenient access from the driver's position 17. The handle is mounted for manual reciprocal movement along the path indicated by the arrow 145. The hand pump is of such construction that the reciprocal movement of the handle along the path indicated by arrow 145 draws ambient air in through the inlet, compresses the air, and delivers the compressed air to the outlet connection 142. The mechanism 10 can, alternatively, be provided with foot operated air pump.

An air cylinder 150, best shown in FIGS. 2, 3, and 6, is affixed on the housing 55 of the starter motor 50 in substantial axial alignment with the pull rod 77 of the solenoid 75. The cylinder has a forward end 152 disposed in juxtaposition to the upper end 86 of the lever 85. The forward end has a central bore 153. The cylinder has a rearward end 155, mounting an air connection 156, disposed above the extension 41 of the bell housing 40. The air cylinder is supported on the housing 55 by a bifurcated bracket 158, best shown in FIGS. 2 and 4, to which it is affixed adjacent to its forward end 152. The bracket has a pair of arms 159 which are individually secured in overlaying relation to the ears 58 of the housing 55 by the bolts 59, as best shown in FIGS. 2 and 4.

The air cylinder 150 has a piston 165, best shown in FIG. 3, fitted therein for slidable movement axially of the cylinder. Thus, the piston and cylinder define an expansible air chamber of which the piston forms a movable wall. A piston rod 167 is mounted on the piston and extends coaxially of the cylinder through the bore 153 to the upper end 86 of the lever 85. A clevis 168 is borne by the piston rod remote from the piston externally of the air cylinder and is pivotally connected to the opposite ends of the second pin 88 of the pull rod 77. The clevises and the upper end of the lever are thus linked together for unitary movement. A helical compression or return spring 175 is captured within the air cylinder concentrically about the piston rod between the piston and the forward end 152 of the air cylinder. The spring thus resiliently urges the piston and elements connected thereto toward their respective positions shown in FIGS. 2 and 3. Accordingly, the pinion gear 72 is resiliently held in disengagement from the ring gear 47.

The mechanism 10 has a first conduit 180 which interconnects the connector 122 attached to the valve stem 37 of the tire 35 and the inlet connection 126 of the valve 125 in air transferring relation. The first conduit has a flexible end portion 182 within the trunk 18 on which the connector 122 is mounted for convenience in connecting the connector to the valve stem. The first conduit has a T-fitting 184 adjacent to the hand pump 140. A branch conduit 185 interconnects the fitting and the outlet connection 142 of the hand pump in air transferring relation. A second conduit 190 interconnects the outlet connection 127 of the valve 125 and the inlet connection 107 of the air motor 100 in air transferring relation. The first conduit, the valve 125 and the second conduit form an air line pneumatically interconnecting the tire 35 and the air motor 100 when the valve 125 is adjusted, using lever 130, to the position establishing communication between the inlet and outlet connections of the valve. The second cnduit has a T-fitting 192 to which a third conduit 195 is connected. The third conduit is connected at its remote end to the connection 156 of the air cylinder 150. Thus, the outlet connection 127 of the valve 125 is connected in air transferring relation to the air cylinder 150.

OPERATION

The operation of the described embodiment of the present invention is believed to be clearly apparent and is briefly summarized at this point. As previously discussed, the elements of the starter motor 50 are disposed as shown in FIG. 3 when the starter motor is electrically de-energized. Under ordinary conditions, when the starter motor is energized the elements of the starter motor assume the positions shown in FIG. 6. When energized, the solenoid 75 draws the pull rod 77 together with the upper end 86 of the lever 85 from the position shown in FIG. 3 to the position shown in FIG. 6. The lever pivots about the first pin 82 to move the pinion gear 72 along the splines 68 and into engagement with the ring gear 47, as shown in FIG. 6. The motor shaft 65 is thereby engaged in driving relation with the engine for cranking by the electrical portion 51 of the starter motor. The auxiliary starter mechanism 10 of the present invention is for use when there is insufficient electrical energy available from the battery of the automobile 15 to energize the starter motor in the manner described. The mechanism 10 can also be employed where some other failure in the primary starting system of the automobile prevents operation of the starter motor.

Where the spare tire 35 is employed as the source of air under pressure, the recommended pressure for the tire may be sufficient for the purpose. However, in order to use the spare tire as a source of air and still have sufficient air left within the tire to permit its use as a spare, it is recommended that air pressure within the spare tire be maintained at approximately 100 pounds per square inch. The excess pressure is then available to power the air motor 100 without deflating the spare tire to the extent that the tire cannot be used "on the ground". This excess pressure will not harm the tire, since the bursting pressure of the automobile tire is well above this pressure.

The tire 65 can be inflated at a service station in the usual manner after removing the connector 122 for access to the valve stem 37. When the tire is inflated to the desired pressure, the connector is reinstalled on the valve stem.

When the spare tire 35 is inflated to a sufficient pressure, the mechanism 10 of the present invention is available for starting the engine 16 whenever the primary starting system is inadequate for the purpose. The mechanism is selectively actuated by moving the lever 130 of the valve 125 to the position in which its inlet connection 126 and outlet connection 127 are connected in air transferring relation. In this position, air under pressure flows from the spare tire through the valve to its outlet connection. Air under pressure flows from the outlet connection through the second conduit 190 to the air motor 100 and through the third conduit 195 to the pneumatic connection 156 of the air cylinder 150. Since the second and third conduits are connected at the T-fitting 192, air under pressure is supplied to the air cylinder whenever air under pressure is supplied to the air motor.

When air under pressure reaches the air cylinder 150, the piston 165 thereof is urged toward the forward end of the air cylinder against compression of the return spring 175. Accordingly, the piston rod 167, the lever 85 and the pull rod 77 of the solenoid 75 are moved into their respective positions shown in FIG. 6. This is, of course, the position previously described as assumed by these elements when the solenoid is electrically energized in normal operation of the starter motor. The pinion assembly 70 and thus the pinion gear 72 is carried into cranking engagement with the ring gear 47 as previously described, so that powered rotation of the motor shaft 65 results in the engine 16 being rotationally driven. Since air under pressure is supplied simultaneously to the air motor 100, the output shaft 105 of the air motor is rotationally driven resulting in rotation of the crankshaft 45 and starting of the engine.

The electrical portion 51 of the starter motor 50 and the air motor 100 produce the same result; that is, rotation of the shaft 65. The solenoid 75 and the air cylinder 150 produce the same result; that is, engagement of the pinion gear 72 with the ring gear 47. Since the same mechanical elements are utilized, the mechanism 10 can be activated simultaneously with the existing electric starting system of the automobile 16. Such simultaneous activation is advantageous under conditions, such as cold weather, in which the electric system has not failed completely, but has insufficient power to start the engine. It should be noted, therefore, that the auxiliary starter mechanism 10 of the electrical starting system of the automobile or both can be employed in the most advantageous combination under the prevailing conditions.

If the spare tire 35 does not contain air under sufficient pressure to start the engine 16, the hand pump 140 is utilized to compress ambient air drawn in through its inlet 141. The compressed air is delivered from the outlet connection 142 of the pump to the tire through the branch conduit 185 and that portion of the first conduit 180 between the T-fitting 184 and the connector 122. Thus, the necessary air pressure can be created in the spare tire and first conduit 180 prior to opening of the valve 125.

When the engine 16 has been started, the lever 130 of the valve 125 is moved to a position in which the inlet connection 126 and outlet connection 127 no longer communicate in air transferring relation, but rather the outlet connection communicates with the exhaust 128. The supply of air under pressure to the motor 100 and cylinder 150 is thus terminated. Thus, the motor 100 ceases to drive the motor shaft 65 and simultaneously air under pressure within the air cylinder is vented to the atmosphere through the third conduit 195 and the exhaust 128. The return spring 175 rapidly expels the air from the air cylinder and returns the piston 165 to the position shown in FIG. 3. Similarly, the piston rod 167, the lever 85, pull rod 77, and pinion assembly 70 are returned to their positions shown in FIG. 3. Thus, the pinion gear 72 is disengaged from the ring gear 47. The valve, therefore, not only selectively energizes and de-energizes the air motor 100 pneumatically, but also simultaneously slides the pinion gear 72 to and from driving engagement with the ring gear and thus the crankshaft 45.

Therefore, the auxiliary starter mechanism of the present invention provides a system which is practical, efficient and fully dependable for starting the engines of automobiles and the like whenever the primary starting system of the engine is inadequate for the purpose and which is well suited for installation on existing vehicles as well as installation at the time of manufacture of the vehicle.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An auxiliary starter mechanism for a vehicle having an engine and a primary starting system including a shaft mounting a drive gear endwardly movable along the shaft to and from a cranking position with the drive gear in driving relation to the engine and the shaft being rotational about its longitudinal axis to rotate the drive gear thereof in driving relation to the engine and a mechanism operable to move the drive gear along the shaft to and from the cranking position, the auxiliary starter mechanism comprising:

A. a motor driven by gas pressure borne by the vehicle and connected in rotational driving relation to the shaft of the primary starting system;

B. a gas conduit mounted on the motor in position to introduce a gas thereto in driving relation to the motor and having a remote end portion;

c. a reservoir containing a gas under pressure and having a coupling operable to release the compressed gas therefrom;

D. a connector mounted on the remote end portion of said gas conduit and adapted to be attached to the coupling of said reservoir to permit gas under pressure to flow from the reservoir into the gas conduit;

E. a gas cylinder borne by the vehicle, linked to said mechanism of the primary starting system and operable when pressurized to move the drive gear of the primary starting system along the shaft to said cranking position; and F. a gas conduit interconnecting the first of said gas conduits and the gas cylinder to pressurize said gas cylinder with gas under pressure from the reservoir.

2. An auxiliary starter mechanism for a vehicle having a spare tire inflated with air under pressure and having a valve stem, an engine and a primary starting system including a shaft mounting a drive gear endwardly movable along the shaft to and from a cranking position with the drive gear in driving relation to the engine and the shaft being rotational about its longitudinal axis to rotate the drive gear thereof in driving relation to the engine and a mechanism operable to move the drive gear along the shaft to and from the cranking position, the auxiliary starter mechanism comprising:

A. a motor driven by air under pressure borne by the vehicle and connected in rotational driving relation to the shaft of the primary startng system;

B. an air conduit mounted on the motor in position to introduce air under pressure thereto in driving relation to the motor and having a remote end portion;

C. a connector mounted on the remote end portion of said air conduit and adapted to be attached to the valve stem of the spare tire to permit air under pressure to flow from the spare tire through the valve stem and into said air conduit;

D. an air cylinder borne by the vehicle, linked to the mechanism of the primary starting system and operable when pressurized to move the drive gear of the primary starting system along the shaft to said cranking position; and E. an air conduit interconnecting the first of said air conduits and the air cylinder to pressurize said air cylinder with air under pressure from the spare tire.

3. The auxiliary starter mechanism of claim 2 wherein a control valve is mounted on the first of said air conduits between the remote end portion theeof and said connection with the second of said air conduits operable in a closed attitude to seal the first of said conduits to retain said air under pressure and operable in an opened attitude to release the air under pressure along the first of said conduits beyond the control valve.

4. The auxiliary starter mechanism of claim 3 wherein a hand pump is mounted in communication with the first of said air conduits between the remote end portion thereof and the control valve and operable to admit air to and to pressurize said air within the first of said air conduits.

* * * * *